United States Patent [19]

Takeshima et al.

[11] Patent Number: 4,908,106

[45] Date of Patent: Mar. 13, 1990

[54] ELECTROPLATING OF FINE PARTICLES WITH METAL

[75] Inventors: Eiki Takeshima; Kiyoshi Takatsu, both of Chiba; Youichi Kojima, Hyogo; Takahiro Fujii, Chiba, all of Japan

[73] Assignee: Nisshin Steel Co., Ltd., Tokyo, Japan

[21] Appl. No.: 340,670

[22] Filed: Apr. 20, 1989

[30] Foreign Application Priority Data

Apr. 25, 1988 [JP] Japan ..... 63-100204

[51] Int. Cl.[4] ..... C25D 5/00

[52] U.S. Cl. ..... 204/23

[58] Field of Search ..... 204/23

[56] References Cited

FOREIGN PATENT DOCUMENTS 156793 12/1981 Japan .

18096 1/1988 Japan .

*Primary Examiner*—T. M. Tufariello

*Attorney, Agent, or Firm*—Wenderoth, Lind & Ponack

[57] ABSTRACT

Disclosed herein suspension electroplating of fine particles with metal. An electroplating operatively equipped with a cathode and anode is charged with a metallic ion-containing electrolyte and particles to be electroplated. The particles have a size of from 0.1 to 10 μm. At least a part of the surface of each particle is conductive. Such a stationary circulating flow of a suspension of the particles in the electrolyte is formed in the bath that the particles are maintained in the suspended condition; the suspension is circulated substantially without coming in contact with the anode; the particles may have a chance of colliding with substantially all surface areas of the working surface of the cathode, and are repeatedly brought in collision with the cathode at a velocity with a normal component of from 0.6 to 6.0 m/min.; and a particle concentration of the suspension at the time of collision is from 30 to 55% by volume. When such a stationary flow has been formed, a current for electroplating is caused to pass, whereupon deposition of metal on the particles proceeds without deposition of the particles and metal on the cathode.

3 Claims, 5 Drawing Sheets

ELECTROPLATING OF FINE PARTICLES WITH METAL

TECHNICAL FIELD OF THE INVENTION

The present invention relates to a process and apparatus for coating metals on surfaces of fine particles of metals, inorganic or organic substances having a particle diameter of from 0.1 to 10 μm by an electroplating process.

PRIOR ART

Metal coated particles obtained by coating certain limited kind of metals on surfaces of particles of ceramics or plastics having a particle diameter of several μm or more by a nonelectrode plating process or a CVD process have heretofore been used as catalysts, for decorative purposes, in powder metallurgy, as particle dispersions for reinforced composite materials and as electrically conductive fillers for electromagnetic shields. When metal coated particles are used in these applications, the smaller the particle diameter, the larger the surface area, and thus, the more excellent in the sintering properties and reactivity.

Among various metal coating processes it is an electroplating process that is the most inexpensive and is capable of coating the most kinds of metals. Many processes have been reported for electroplating metallic particles having a particle diameter of several tens μm. For example, see JP-A-56-156793. However, there is scarcely found a report on a process for electroplating fine particles of a size of 10 μm or less, except for that we have proposed in JP-A-63-18096.

JP-A-63-18096 relates to a process for coating ultrafine particles ceramics and plastics having a particle diameter ranging from 100 Å to 1.0 μm with metal by an electroplating process. According to the process, particulate ceramics or plastics are finely divided into primary ultrafine particles, which are subjected to a plasma treatment, a sensitizing treatment with tin compounds, an activating treatment with palladium compound and nonelectrode plating to impart electric conductivity. The so obtained electrically conductive ultrafine particles are suspended in a metallic ion-containing electrolyte, and using such a suspension electroplating and ultrasonic treatments are repeatedly carried out. In other words, whereas according to the process proposed in JP-A-62-18096, metallic ions in the electroplating bath are electrochemically deposited on surfaces of the ultrafine particles suspended in the bath, it is taught that an optimum suspended condition can be advantageously maintained by ultrasonic vibration.

PROBLEMS IN THE ART AND OBJECT OF THE INVENTION

We have experienced, however, that the process proposed in JP-A-63-18096 involves the following problems:

(1) In cases of ultrafine particles having a particle diameter of less than 0.1 μm, even if urtrasonic treatments are repeatedly carried out, electrophoresis preferentially proceeds so that the ultrafine particles are likely to deposit on a cathode plate in the form of dispersed plating. On that account, the yield of electroplating on ultrafine particles is normally as low as about 20% or lower.

(2) In cases of fine particles having a particle diameter of from 0.1 to 1.0 μm, transfer of electric charges upon collision of fine particles with a cathode is not necessarily smooth so far as an apparatus disclosed in the publication is concerned. On that account, electrodeposition of metallic ions on the cathode plate considerably proceeds, resulting in a yield of electroplating on fine particles of at most from 50 to 70%. The same tendency is observed in cases of fine particles having a particle diameter of up to about 10 μm.

To summarize it has been very difficult to uniformly electroplating each and every particle of fine particles having a particle diameter of not more than 10 μm in a high yield (for example, 90% or higher).

The invention is to solve the problems discussed above associated with the prior art, and an object of the invention is to provide a process and apparatus for electroplating fine particles having a particle diameter of from 0.1 to 10 μm capable of uniformly coating each and every particle with various metals at a high yield.

SUMMARY OF THE INVENTION

According to one aspect of the invention there is provided a process for electroplating fine particles with metal by suspending electrically conductive fine particles in a metallic ion-containing electrolyte in an electroplating bath equipped with a cathode and anode, and passing a direct electric current between the cathode and anode thereby depositing metallic ions in the electrolyte on surfaces of fine particles. wherein said fine particles have a particle diameter of from 0.1 to 10 μm, wherein a flow of a suspension of said fine particles in the electrolyte continuously flowing is forcibly formed in said bath while keeping said fine particles in the suspended condition in said electrolyte, wherein said flow of said suspension is controlled so that its main direction of flow in the bath is such that while said suspension is circulated substantially without coming in collision with said anode, said fine particles in said suspension may have a chance of colliding with substantially all surface areas of said cathode that are exposed to said bath, and wherein a flow rate and particle concentration of said suspension are controlled so that said fine particles may repeatedly come in collision with said cathode at a velocity with a normal component of ranging from 0.6 to 6.0 m/min., and a particle concentration of said suspension at the time of collision is from 30 to 55% by volume.

The electrically conductive fine particles may be particulate inorganic or organic fine substance having formed on said surface an electrically conductive film, or particulate metal.

According to another aspect of the invention there is provided an apparatus for electroplating fine particles which comprises a tubular vessel containing an electroplating electrolyte disposed with its axis vertical, a cathode plate disposed at the bottom of said vessel with its electrically conductive surface horizontal, an anode disposed nearly at a level of said electrolyte, an electric source for applying a predetermined electric potential between said cathode plate and anode, an inhaling pipe having an opening for inhaling the electrolyte from said vessel at a level between said cathode plate and said anode an exhaling pipe having an opening for exhaling the electrolyte into said vessel at a level between said cathode plate and said anode, a passage communicating said inhaling pipe with said exhaling pipe for circulation of said electrolyte therethrough and a pump for the circulation of said electrolyte installed in said passage, wherein said opening for exhaling the electrolyte is disposed so that it opens downwardly towards the electrically conductive surface of said cathode plate while the opening for inhaling the electrolyte is disposed at a level below the lower end of said anode, whereby fine particles to be plated having a particle diameter of from 0.1 to 10.0 μm suspended in said electrolyte may be repeatedly circulated through said passage and repeatedly brought in collision with the electrically conductive surface of said cathode plate.

In accordance with a further aspect of the invention there is provided an apparatus for electroplating fine particles which comprises a tubular vessel containing an electroplating electrolyte disposed with its axis vertical, a cathode plate disposed at the bottom of said vessel with its electrically conductive surface horizontal, an anode disposed nearly at a level of said electrolyte, an electric source for applying a predetermined electric potential between said cathode plate and anode, a propeller for driving the electrolyte downwardly toward said cathode plate and flow-rectifying plates disposed vertically on the inner wall of said vessel with their upper ends at a level below the lower end of said anode, whereby fine particles to be plated having a particle diameter of from 0.1 to 10.0 μm suspended in said electrolyte may be repeatedly brought in collision with the electrically conductive surface of said cathode plate.

DETAILED DESCRIPTION OF THE INVENTION

Figure 1:
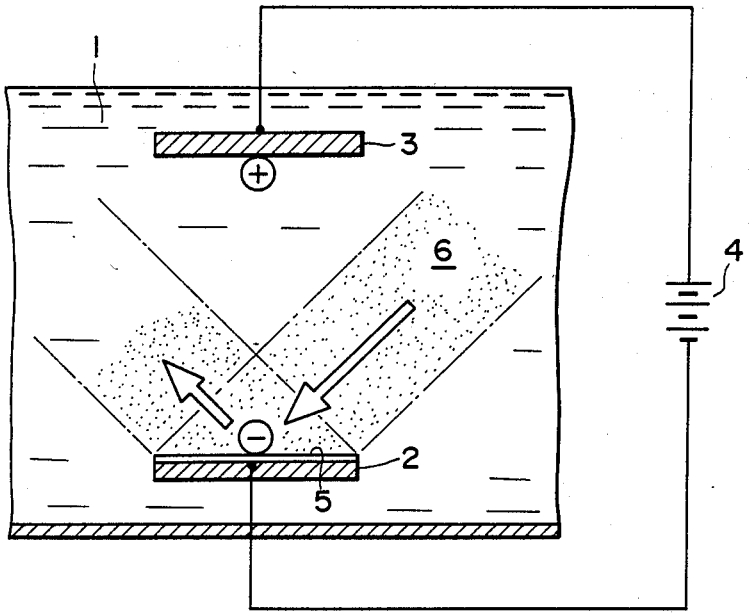
FIG. 1 is a view for diagrammatically illustrating a principle underlying the invention.

According to the invention fine particles having a particle diameter within the range between 0.1 μm and 10.0 μm of metal, inorganic substance (e.g., ceramics) or organic substance (e.g., plastics) are coated with various metals by an electroplating process, and thus, the fine particles should have electric conductivity sufficient for metallic ions in an electroplating bath to be deposited on surfaces thereof. That is, it is essential that at least part of surfaces of individual particles to be processed should be electrically conductive. Normally, a pretreatment of fine particles for rendering them electrically conductive, such as nonelectrode plating, is required prior to the electroplating according to the invention.

Even with metallic fine particles, electroplating thereof often does not proceeds satisfactorily because they are normally covered with oxide films. Accordingly it is generally preferred to render the metallic particles sufficiently conductive by acid pickling them to remove the oxide films or by subjecting them to nonelectrode plating. In cases of low conductive inorganic or organic substances, it is necessary to form an electrically conductive film on the surface of each particle thereof by nonelectrode plating.

The nonelectrode plating of fine particles may be carried out by processes known per se, for example by processes described in JP-A-63-18096. That is, the fine particles are treated so that a catalyst such as metallic palladium is deposited on surfaces thereof, and thereafter dipped in a nonelectrode plating liquid. Procedures for depositing the catalyst on surfaces of fine particles include, for example, a procedure wherein fine particles are dipped in an acidic aqueous solution of a stannous salt, and then dipped in an acidic aqueous solution of a palladium salt (a so-called sensitizing and activating process); a procedure wherein fine particles are dipped in a so-called aqueous colloidal palladium solution containing a stannous salt and a palladium salt, and then washed with acid; a procedure wherein fine particles are dipped in an acidic aqueous solution of a palladium salt, and then dipped in an aqueous solution of a reducing agent; modifications of the above-mentioned procedures; and a procedure utilizing a reaction of a palladium salt such as PdCl2 with a silane coupling agent such as gamma-aminopropyltriethoxysilane. Of these, the sensitizing and activating process is particularly preferred from a view point of effective and uniform deposition of the catalyst. We prefer to repeat this process two or three times.

Metal to be nonelectrode plated can be copper, nickel, cobalt, tin, silver, gold, platinum, nickel alloys and cobalt alloys, and may be selected depending upon the intended use and functions of the final fine particle product. The nonelectrode plating liquid may be acidic, neutral or alkaline, so far as it does not dissolve the fine particles to be treated. The nonelectrode plating process which can be used herein is not particularly limited by a process temperature or by a reducing agent when used. While the thickness of the electrically conductive film formed by the nonelectrode plating process depends upon the intended use and functions of the final product, when considered from feasibility of the subsequent electroplating process according to the invention, it is preferably within the range from about 300 and about 1000 Å.

The electrically conductive fine particles so prepared are electroplated by the process according to the invention, in which such fine particles are suspended in an electrolyte of a electroplating bath in a predetermined particle concentration; and a flow of the suspension flowing in a predetermined direction at a predetermined velocity is forcibly formed in the bath and circulated so that it may come in collision with a cathode plate at a velocity with a predetermined normal component substantially without coming in contact with anode. We have found that if the process is carried out under conditions (1) that the suspension of fine particles formed in and forcibly caused to flow through the bath has a particle concentration of from 30 to 50% by volume at least at the time of its collision with the cathode plate;

(2) that the suspension is circulated through the bath so that it may not substantially come in contact with the anode; and (3) that the circulated suspension is repeatedly brought in collision with the cathode plate at a velocity with a normal component of ranging between 0.6 m/min. and 6.0 m/min., individual particles having a particle diameter of from 0.1 to 10 μm, each and every, may be uniformly electroplated at a yield as high as 90% or more, substantially respective of the concentration of metallic ions in the electroplating liquid.

FIG. 1 is a diagrammatic view of a flow of suspended fine particles for illustrating a principle underlying the process according to the invention. As shown in FIG. 1, in an electroplating liquid 1, that is, a metal ion-containing electrolyte of an electroplating bath, a cathode plate 2 and an anode 3 are disposed face to face in spaced apart relation, and electricity is caused to pass from the anode to the cathode through the electrolyte between them by means of an electric source 4. Against substantially all areas of electrically conductive surface 5 of the cathode plate 2 that are exposed to the electroplating liquid 1, a flow of suspended fine particles 6 is projected. It is essential in the process according to the invention that the flow of suspended fine particles 6 is forcibly circulated through the bath so that it may be projected against all areas of the exposed surface 5 of the cathode plate 6 without coming in contact with the anode 3. Further, it is necessary that a particle concentration of the flow of suspended fine particles at the time the flow 6 is brought in collision with the cathode is from 30 to 55% by volume and that the flow comes in collision with the cathode at a velocity with a normal velocity component of ranging from 0.6 to 6.0 m/min. Keeping these conditions, the flow 6 of suspended fine particles is repeatedly brought in collision with the cathode.

Figure 2:
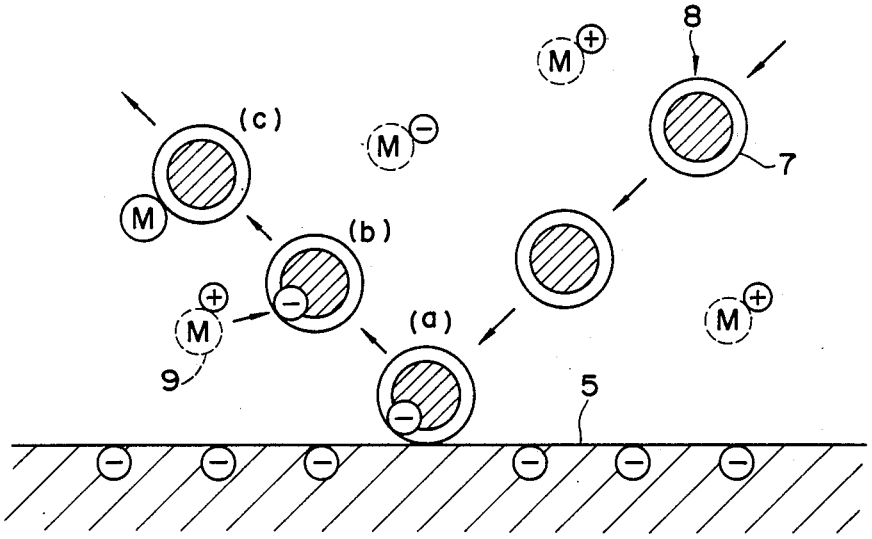
FIG. 2 is a view for diagrammatically illustrating transfer of electric charges on a single fine particle which is coming in collision with and leaving the cathode.

FIG. 2 is a view for diagrammatically illustrating transfer of electric charges on a single fine particle which is coming in collision with and leaving the cathode; At the moment a fine particle 8 having an electrically conductive film 7 on its surface comes in collision with the conductive surface 5 of the cathode 2, electric charges of the cathode transfer to the conductive film 7 of the particle 8, as shown by particle (a) in FIG. 2. At the moment the charged particle (a) has left the cathode, as shown by particle (b) in FIG. 2, metallic ions which are present in the vicinity of the particle (b) electrostatically come in contact with the particle (b) and deposit thereon, as shown by particle (c) in FIG. 2. If the condition that all areas of the exposed cathode surface are unceasingly hit by fine particles is continuously met, metallic ions in the electroplating liquid may deposit on surfaces of suspended fine particles without depositing on the working surface 5 of the cathode. In order to effectively maintain this desired condition, the particle concentration of from 30 to 55% by volume and particle velocity with a normal component of from 0.6 to 6.0 m/min. prescribed herein are required.

Figure 3:
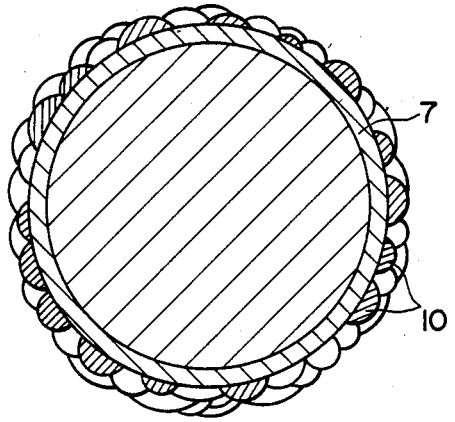
FIG. 3 is a conceptional enlarged cross-sectional view of a fine particle electroplated by the process according to the invention.

As described in Example 1, it has been found that upon examination by X-ray diffractometry the fine particle product as electroplated by the process according to the invention does not exhibit any diffraction peak inherent in the electroplated metal. From this fact it is believed that as diagrammatically shown in FIG. 3, in the process according to the invention, there is formed on the surface of an electrically conductive film 7 of a fine particle an electroplated metallic film comprising an aggregate of metal deposits 10 having a surface area far smaller than that of the electrically conductive film 7 and that the thus formed electroplated metallic film, in association with the fact that the fine particle is extremely small, becomes nearly amorphous exhibiting no diffraction peak in its X-ray diffraction pattern.

Figure 4:
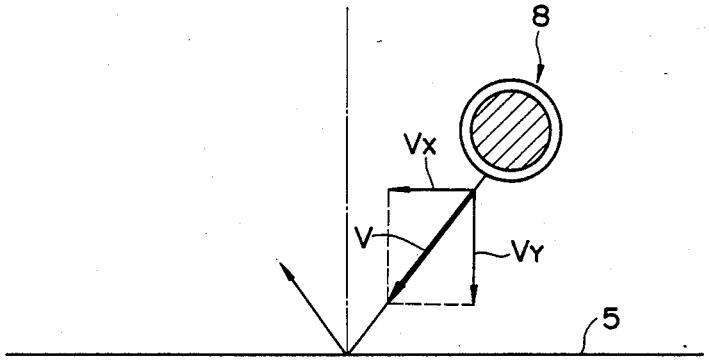
FIG. 4 is a view for illustrating a normal velocity component of a fine particle which is about to come in collision with the cathode.

FIG. 4 is view for illustrating a normal velocity component of a fine particle which is coming in collision with the working surface 5 of the cathode. As shown in FIG. 4, the velocity vector V of a fine particle 8 in its moving direction upon collision with the working surface 5 of the cathode is composed of a horizontal velocity component $V_X$, which is parallel to the working cathode surface 5, and a normal velocity component $V_Y$, which is perpendicular to the working cathode surface 5. In the process according to the invention it is essential to adjust the velocity of the flowing suspended fine particles so that the above-mentioned normal velocity component may fall within the range from 0.6 to 6.0 m/min.

When electrodeposition is carried out with an electrolyte containing therein suspended fine particles of a size on the order of from 0.1 to 10 μm, it has been frequently observed that the particles are deposited on a cathode while being enveloped by electrically deposited metallic ions, thereby forming a dispersed plated film on the cathode. The operation mechanism for this phenomenon of forming eutectoid is not yet fully understood, although there have been proposed three types of common views, respectively based on eutectoid formation by chemical absorption, eutectoid formation by electrostatic attraction and co-precipitation in the electroplated film by mechanical stirring. In order to efficiently electroplate fine particles, it is required on the one hand to prevent fine particles from depositing in the dispersed electroplated film. On the other hand it is also required that electric charges should be smoothly transferred from the cathode to the fine particles. These requirements are conflicting from each other. While the problem of simultaneously fulfilling the conflicting requirements has now been successfully solved by the invention, reasons for the success are believed as follows.

In an article entitled "Suspension Electrolysis of Metal", by Hiroshi KAMETANI, Bulletin of the Society of Metal and Metallurgy of Japan, No. 3, Vol. 13 (1974), pages 201–215, there are described the following three theories underlying processes for electroplating suspended particles:

(1) Contact theory

Electroplating of particles gradually proceeds by unceasingly bringing particles in contact with the working surface of a cathode;

(2) Cluster theory

A plurality of particles simultaneously coming in collision with a cathode form a cluster on the cathode. The cluster is maintained in the as formed condition for a certain time, for which electricity passes inside of the cluster, whereby electroplating of particles proceeds; and (3) Collision theory Electroplating of particles proceeds by repeated collision of individual particles.

The above-mentioned theories are, however, proposed on electroplating of particles having a size of several tens μm or larger. The article is completely silent with respect to electroplating of fine particles of a size of 10 μm of less. We have presumed that when fine particles of a size of 10 μm of less are processed by the process according to the invention electroplating of particles is primarily attributed to the phenomenon (3) above, although the phenomena (1) and (2) above might occur to some extent. According to this presumption an electric current (i) flowing through a particle can be expressed by the following equation:

$$i=\pi \cdot Dp^2 \cdot v \cdot C \cdot \Delta\phi m$$

wherein Dp is a diameter of the particle, v is a frequency of collision of particles per unit area and unit time, C is a capacity of an electric double layer of the surface of particle, and $\Delta\phi m$ is a change in potential of particle due to collision.

According to this equation, the electric current is proportional to the square of the particle diameter. Thus, the smaller the particle diameter, the more drastically the electric current decreases. Further, the smaller the frequency of collision, the smaller the electric current. Accordingly, in order to successfully electroplate extremely fine particles having a particle diameter of from 0.1 to 10.0 μm, it is essential to greatly increase the frequency of collision of particles. More specifically, it is desirable to realize the highest possible particle concentration of the suspension and to bring the suspended particles in collision with the cathode at a velocity of a sufficiently large normal velocity component.

Calculation on models of the closest packing of spherical particles indicates that the hexagonal closest packing can be achieved at a particle concentration of 74.05% by volume, whereas the cubic closest packing at a particle concentration of 52.35% by volume. According to this way of thinking, it is said that the experimental closest packing of particles would be achieved at a particle concentration of 62.0% by volume. On the other hand, according to Alder's transition theory based on considerations of repelling and cohesive forces of aggregated particles, it is said that particles are in an ordered condition (solid state) when a particle concentration is above 55.0% by volume; in a transition condition (transition state) at a particle concentration of from 55.0 to 50% by volume; and in a disordered condition (liquid state) at a particle concentration of below 50% by volume. At a particle concentration of above 55.0%, the particle aggregation is in the solid state, and therefore stirring is impossible. As the particle concentration approaches and becomes below 50% by volume, it is possible to stir and fluidize the particles. However, an unduly low particle concentration should be avoided, because the lower the particle concentration, the smaller the frequency of collision of particles. We have experimentally found that for the purpose of the invention the optimum particle concentration is from 30 to 55% by volume in order to realize the highest possible frequency of collision of particles while simultaneously ensuring an effective stirring and fluidizing of particles.

In carrying out the process according to the invention, the particle concentration of the suspension and the normal velocity component of particles coming in collision with the cathode are related from each other. More specifically, if the particle concentration of the suspension is less than 30% by volume and the normal velocity component of particles at the time of collision with the cathode is less than 0.6 m/min., electroplating of particles proceeds not at all and metallic ions are all deposited on the cathode. If the particle concentration of the suspension is less than 30% by volume and the normal velocity component of particles at the time of collision with the cathode is more than 6.0 m/min., electroplating of particles may proceed but to a limited extent and metallic ions are primarily deposited on the cathode. This is believed because transfer of charge between particles and the cathode plate is insufficient in view of short contact time. In a case wherein the particle concentration of the suspension is more than 55% by volume and the normal velocity component of particles at the time of collision with the cathode is less than 0.6 m/min., electroplating of particles proceeds without any deposition of metallic ions on the cathode plate. However, because of the highly aggregated state of the particles, it is difficult on the one hand to uniformly electroplate the particles, in other words, there remains considerable amounts of particles having at least a part nonplated, and on the other hand, the available electric current is very small and an attempt of forcibly increasing the effective current invites such phenomena that instead of the desired electrochemical reaction electrolysis of water evolving hydrogen gas proceeds, drastically decreasing the current efficiency of the process. Finally the condition including a particle concentration of above 55% by volume and a normal velocity of more than 6.0 m/min. of particles at the time of collision with the cathode means high speed flowing of a very viscous slurry, which is not only technically difficult to realize but also requires to consume much energy, and thus, the last mentioned condition is not advantageous.

As apparatus for conveniently carrying out the process according to the invention we have developed the apparatus shown in FIG. 5 and that shown in FIGS. 6 and 7, which will now be described in detail.

PREFERRED EMBODIMENTS OF THE APPARATUS ACCORDING TO THE INVENTION

Figure 5:
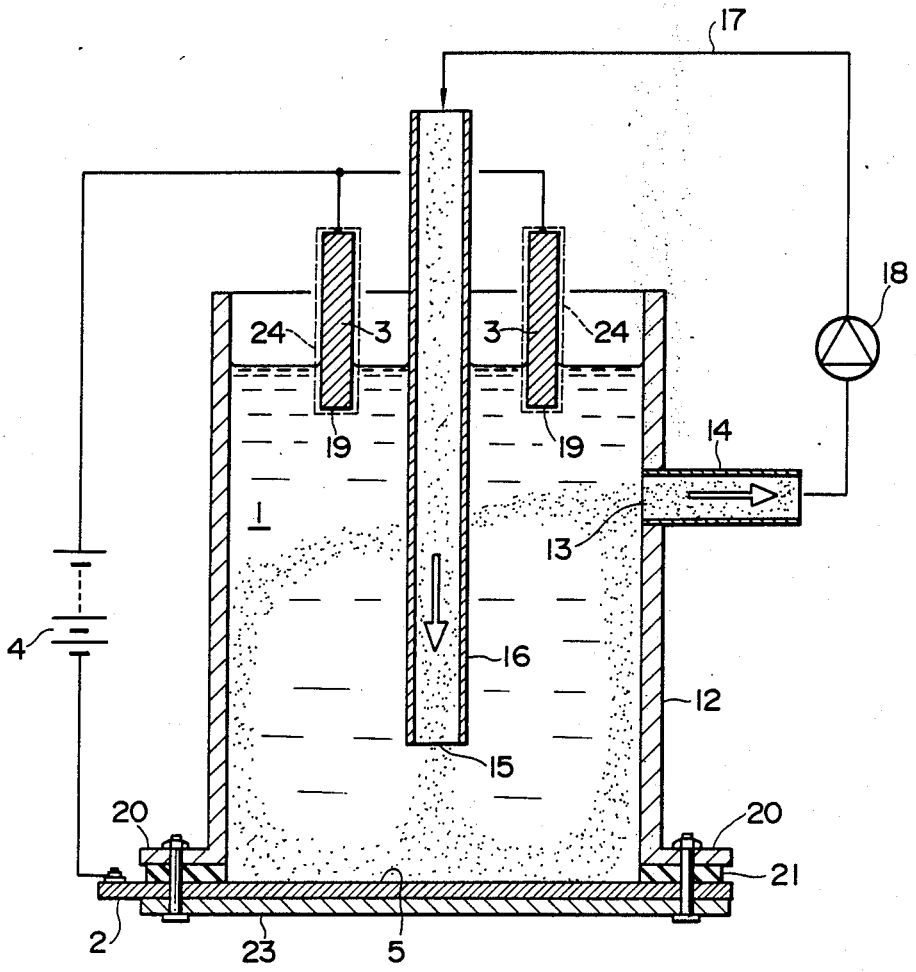
FIG. 5 is a schematic vertical cross-sectional view of an apparatus according to the invention.

An apparatus according to the invention shown in FIG. 5 comprises a tubular vessel 12 containing an electroplating electrolyte 1 disposed with its axis vertical, a cathode plate 2 disposed at the bottom of said vessel 12 with its electrically conductive surface 5 horizontal, an anode 3 disposed nearly at a level of said electrolyte, an electric source 4 for applying a predetermined electric potential between said cathode plate 2 and anode 3, an inhaling pipe 14 having an opening 13 for inhaling the electrolyte from said vessel at a level between said cathode plate 2 and said anode 3, an exhaling pipe 16 having an opening 15 for exhaling the electrolyte into said vessel at a level between said cathode plate 2 and said anode 3, a passage 17 communicating said inhaling pipe 14 with said exhaling pipe 16 for circulation of said electrolyte therethrough, and a pump 18 for the circulation of said electrolyte installed in said passage 17, wherein said opening 15 for exhaling the electrolyte is disposed so that it opens downwardly towards the electrically conductive surface 5 of said cathode plate 2 while the opening 13 for inhaling the electrolyte is disposed at a level below the lower end of said anode 3, whereby fine particles to be plated having a particle diameter of from 0.1 to 10.0 μm suspended in said electrolyte may be repeatedly circulated through said passage 17 and repeatedly brought in collision with the electrically conductive surface 5 of said cathode plate 2.

In the apparatus illustrated in FIG. 5, the tubular vessel 12 containing the electrolyte 1 comprises a vertically disposed hollow cylinder composed of an insulating material, and the whole area of the bottom opening of the hollow cylinder is sealed with a disc-shaped cathode plate 2. More specifically, the tubular vessel 12 is provided with a flange 20 at the lower end, to which the cathode plate 2 is securely fixed together with an annular packing 21 and a base plate 23 by means of bolts and nuts. The exhaling pipe 16 having the exhaling opening 15 at its lower end is disposed concentrically with the tubular vessel 12. The inhaling opening 13 of the inhaling pipe 14 opens halfway down the tubular vessel 12 at a level below the lower end 19 of the anode 3 and above the exhaling opening 15.

The apparatus is charged with an amount of fine conductive particles, which initially accumulate at the bottom of the vessel 12. When the pump 18 is driven, a flow of the electrolyte carrying the fine particles and circulating through the passage 17 is formed. After a certain period of tine the solid concentration of the circulating electrolyte becomes a certain constant value, if conditions are appropriate. In the vessel 12, a suspension of fine particles in the electrolyte is exhaled from the opening 15 to be diversified toward the whole area of the working surface 5 of the cathode plate 2. Particles in the exhaled suspension are brought in collision with the working surface 5 of the cathode plate 2 at a velocity of a certain normal component, travel toward the inner wall of the vessel 12, and caused to flow upwardly along the inner wall toward the opening 13 where they are inhaled into the inhaling pipe 14. Thus, there is formed such a stationary circulating flow of the suspension that it is exhaled from the opening 15 into the vessel 12, brought in collision with the whole working surface 5 of the cathode plate 2, inhaled through the opening 13 into the inhaling pipe 14 and again exhaled from the opening 15. The opening 13 is disposed below the lower end 19 of the anode 3 with an appropriate distance therebetween, whereby the circulating flow of the suspension will not come in contact with the anode. It is preferred to cover the anode 3 with an anode bag 24 made from electrically nonconductive fibers in order to further ensure isolation of the anode from the circulating flow of the suspension. Preferably, the opening 13 for inhaling is disposed at a level above the opening 15 for exhaling, or otherwise normal velocity components of particles coming in collision with the working surface 5 of the cathode will be decreased and particle concentration of the suspension coming in collision with the cathode may be deviated.

The velocity of the suspension at the time of collision with the working surface 5 of the cathode 2 can be adjusted by controlling the rotation of the pump 18. Whereas the particle concentration of the suspension at the time of collision with the working surface 5 of the cathode 2 can be primarily adjusted by varying an amount of charged particles in the case of an apparatus of a given capacity, and can be finely adjusted by adjusting a level of the exhaling opening 15 and/or the rotation of the pump 18.

When there has been formed in the apparatus a desired stationary flow of a suspension of fine electrically conductive particles of a size of from 0.1 to 10.0 μm in an metallic ion-containing electrolyte, said suspension having a particle concentration of from 30 to 55% by volume at the time of collision with the working surface 5 of the cathode 2, said particles being brought in collision with the working surface 5 of the cathode at a velocity with a normal component of from 0.6 to 6.0 m/min., the electric source 4 is actuated to start electroplating. By doing so, as demonstrated hereinafter by working Examples of the invention, the fine particles can be electroplated with the metal at high yield, without any deposition on the working surface 5 of the cathode 2.

Figure 6:
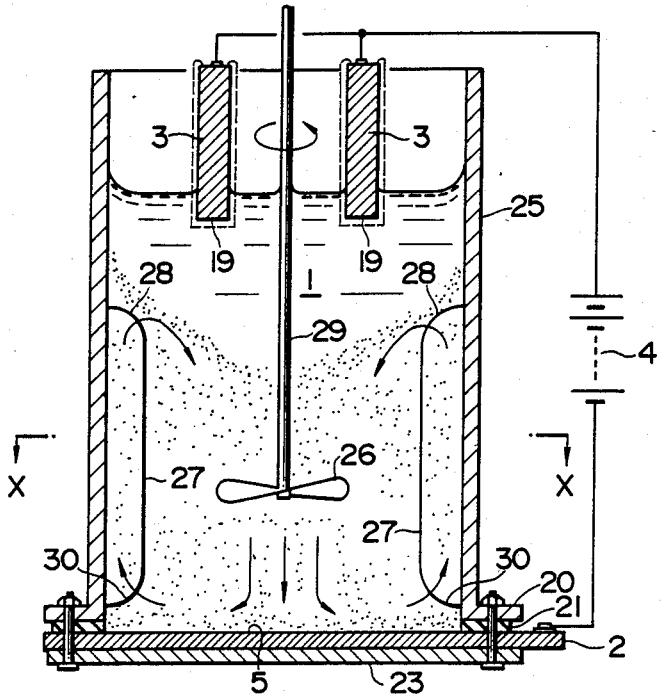
FIG. 6 is a schematic vertical cross-sectional view of another apparatus according to the invention.
Figure 7:
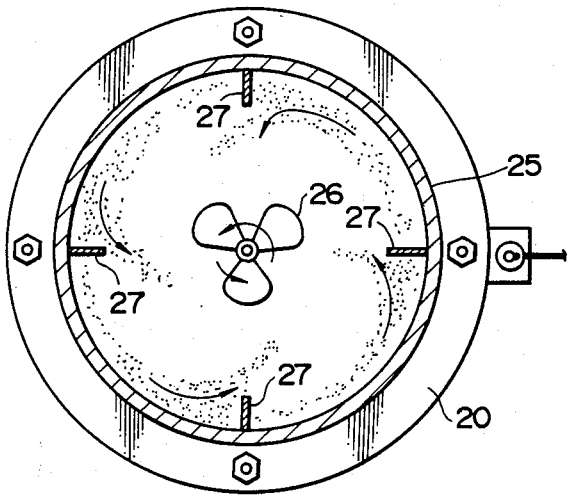
FIG. 7 is a cross-sectional view of the apparatus of FIG. 6 along line X—X.

An apparatus according to the invention shown in FIGS. 6 and 7 comprises a tubular vessel 25 containing an electroplating electrolyte disposed with its axis vertical, a cathode plate 2 disposed at the bottom of said vessel with its electrically conductive surface 5 horizontal, an anode 3 disposed nearly at a level of said electrolyte, an electric source 4 for applying a predetermined electric potential between said cathode plate 2 and anode 3, a propeller 26 for driving the electrolyte downwardly toward said cathode plate 2 and flow-rectifying plates 27 disposed vertically on the inner wall of said vessel with their upper ends 28 at a level below the lower end 19 of said anode 3, whereby fine particles to be plated having a particle diameter of from 0.1 to 10.0 μm suspended in said electrolyte may be repeatedly brought in collision with the electrically conductive surface of said cathode plate.

In the apparatus illustrated in FIGS. 6 and 7, the tubular vessel 25 containing the electrolyte 1 comprises a vertically disposed hollow cylinder composed of an insulating material, and the whole area of the bottom opening of the hollow cylinder is sealed with a disc-shaped cathode plate 2, as in the apparatus illustrated in FIG. 5. The tubular vessel 25 is provided with a flange 20 at the lower end, to which the cathode plate 2 is securely fixed together with an annular packing 21 and a base plate 23 by means of bolts and nuts. The propeller 26 is secured to a shaft of rotation 29, which is disposed coaxially with the tubular vessel 25 and is driven to rotate around its axis by a motor (not shown) disposed outside the vessel 25. The propeller 26 is located in the electrolyte at a level above the working surface 5 of the cathode 2 with a predetermined distance therefrom, and drives the electrolyte by its rotation toward the working surface 5 of the cathode 2. The flow-rectifying plates 27, each comprises an elongated plate having a width smaller than a radius of the cylindrical vessel 25, preferably a width of from 1/6 to ⅓ of the radius of the vessel 25, and is vertically mounted with its one longitudinal side secured on the inner wall of the vessel 25. In the illustrated apparatus, as best seen from FIG. 7, four flow-rectifying plates 27 are disposed on the inner wall of the vessel 25, at the same interval of 90° with surfaces of the plates radially extending. The number direction of the flow-rectifying plates 27 are not strictly critical provided that rising currents of the suspension along the inner wall of the vessel 25 may be formed. The lower end 30 of each flow-rectifying plate 27 is preferably at a level above the working plate 5 of the cathode 2, and the upper end 28 of each flow-rectifying plate 27 must be substantially below the lower end 19 of the anode 2 which is disposed near the level of the electrolyte 1 in the vessel 25.

When the apparatus is charged with an electroplating liquid and particles to be electroplated, and the propeller 26 is caused to rotate, a revolving propelling force is imparted to the liquid whereby there is formed a flow of a suspension of particles in the electroplating liquid which flow is directed toward the working surface 5 of the cathode plate 2. The revolving flow of the suspension which has come in collision with the working surface 5 of the cathode plate 2 is then directed toward the inner wall of the vessel 25, and then flows upwardly along the flow-rectifying plates 27 with its revolution being rectified by the plates 27. At locations slightly above the upper ends 28 of the flow-rectifying plates 27, the flow alters its direction toward the center of the vessel 25 and downwardly owing to particles' own weight and a back pressure of the propeller 26, and is again directed to the working surface 5 of the cathode 2 by the action of the propeller 26. By suitably locating the flow-rectifying plates 27 with their upper ends 28 below the lower end 19 of the anode 3, the suspension can be circulated without coming in contact with the anode 3. Continuous rotation of the propeller 26 will establish and maintain such a condition that the particles may have a chance of being brought in collision with all the areas of the working surface 5 of the cathode 2 at a velocity of a certain normal component. The normal velocity component of particles coming in collision with the working surface 5 of the cathode 2 can be adjusted by controlling the speed of rotation of the propeller 26, while the particle concentration of the suspension can be adjusted by adjusting the relative volume of the charged particles.

Figure 8:
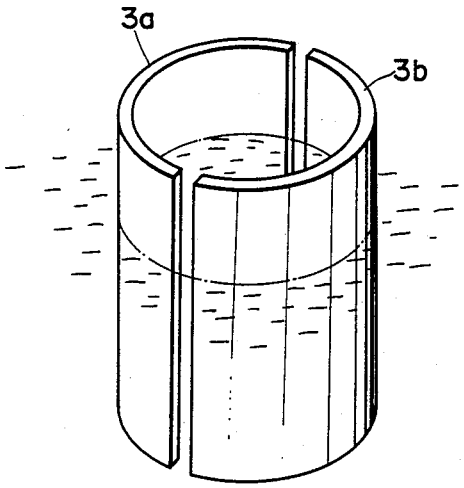
FIG. 8 is a perspective view of an anode which may be used in the apparatus of FIG. 6.

It is advantageous that the apparatus has a structure symmetrical about the center axis of the vessel 25 so that the circulating flow of the suspension may behave symmetrically. For this purpose a cylindrical anode is preferred. FIG. 8 illustrates an anode of this type. The anode shown in FIG. 8 comprises half cylinders 3*a* and 3*b* which have configurations are arranged as if a single cylinder were cut into two halves by a plane passing through the axis of said cylinder. Such an anode structure is not only convenient for an installation purpose but also preferable in that it prevent the revolving flow of suspension in the vessel 25 from being disturbed, thereby decreasing particles floating toward the vicinity of the anode. The shaft 29 of the propeller 26 is arranged so that it penetrate through a central space of the cylindrical anode.

Figure 9:
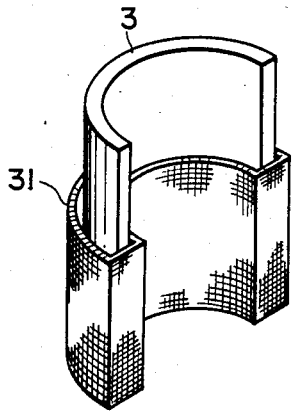
FIG. 9 is a perspective view of an anode protected by an anode bag.

FIG. 9 illustrates an example of an anode bag 31 which wraps at least that part of the anode which is immersed in the electroplating liquid. The anode bag 31 is made of a nonconductive and liquid permeable fabric such as a synthetic fiber fabric, as is the case with the example shown in FIG. 5. The use of the anode bag 31 prevents particles in the electroplating liquid from coming in contact with the anode while permitting the liquid to come in contact with the anode.

Figure 10:
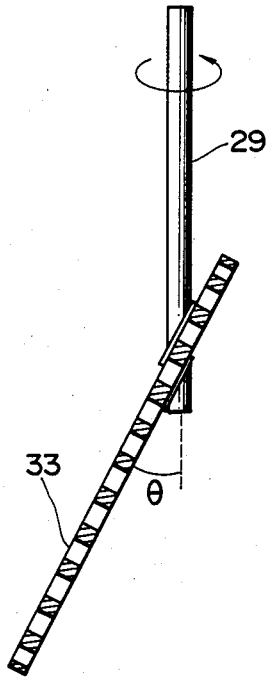
FIG. 10 is a side view of a rotor which may be used in the apparatus of FIG. 6.
Figure 11:
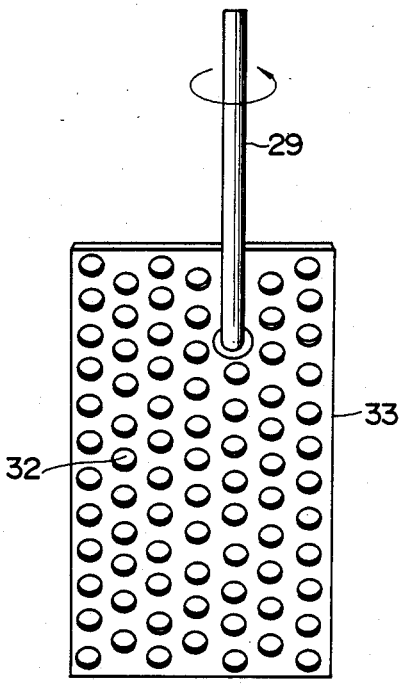
FIG. 11 is a front view of the rotor of FIG. 10.

FIGS. 10 and 11 illustrate another example of the propeller or rotor 26 which may be used in the apparatus of FIG. 6. The illustrated rotor 26 comprises a punched board 33 which is provided with a plurality of perforations 32 uniformly and which is securely fixed to a shaft of rotation 29 with a certain tilt angle which is normally within the range between 10° and 25°, and preferably from 10° to 20°. This tilt punched board rotor provides better stirring effect, whereby a flow of suspension of particles in which the particles are uniformly dispersed can be formed, and in consequence, all the areas of the working surface 5 of the cathode plate 2 may be hit by fragmentary flows of suspension having substantially the same particle concentration and velocity.

The apparatus shown in FIGS. 6 and 7 using the propeller 26, in particular, the tilt punched board rotor 33, is particularly suitable for the establishment of a condition including a particle concentration of near the upper limit (for example from 50 to 55% by volume) and a normal velocity component of near the lower limit (namely, 0.6 m/min. or slightly higher). Whereas the apparatus shown in FIG. 5 is particularly suitable for the establishment of a condition including a particle concentration of near the lower limit (namely, 30% by volume or slightly higher) and a normal velocity component of near the upper limit (namely, 6.0 m/min. or slightly lower). Both the apparatus can, however, realize the process conditions prescribed herein. More specifically, they can establish flowing conditions for the suspension substantially uniform in all directions while maintaining the velocity of particles within the prescribed range; they can maintain highly viscous slurry conditions prescribed herein of a particle concentration as high as from 30 to 55% by volume; they can provide high frequency of collision not only between particles but also between the cathode plate and particles, thereby ensuring smooth and efficient transfer of charges; and the can form a circulating flow of suspension which does not come in contact with the anode.

As means for causing suspended particles to flow, there are conceivable, in addition to those described herein with reference to FIGS. 5 and 6, other devices utilizing or based on a vertically movable perforated plate, a fluidized bed, vibrated bed, a shaking vessel and gas blowing. We have experienced, however, that with such other devices it is difficult to realize a sufficiently high normal velocity component of particles coming in collision with a cathode or to unceasingly maintain the normal violist component within the range of from 0.6 to 6.0 m/min. prescribed herein in cases wherein the particle concentration of the suspension is at least 30% by volume. On that account, other devices mentioned above frequently result in preferential deposition of metal on the cathode plate.

As is known in the art, an electric double layer formed on a fine particle as contemplated herein acts as a film of considerable electric resistance. With the apparatus according to the invention, it is possible to bring particles in collision with the cathode at an angle of near 90° and to maintain the velocity of particles coming in collision with the cathode at a high level as requested herein. It is believed therefore that transfer of charges to and from particle proceeds even if an electric double layer is formed of the particle. In fact, with the apparatus according to the invention, such conditions that metal is deposited selectively on the surface of particles while dispersed deposition of particles on the cathode being prevented can be established and maintained. In the case of ultrafine sub-micron particles, it is required to increase the particle concentration of the suspension and the normal velocity component of particles coming in collision with the cathode within the ranges prescribed herein, in order that every particle may be uniformly electroplated. The smaller the particle this requirement becomes the more important. In spite of their relatively simple structure the apparatus according to the invention make it possible to meet this requirement. We have found, however, that it is extremely difficult to successfully electroplate ultra-fine particles smaller than 0.1 μm. This is believed because such ultra-fine particles render the suspension bulky and viscous, and thus, it is technically very difficult to prepare a suspension of increased particle concentration for the purpose of increasing the frequency of collision of particles which is essential in the suspension electroplating process.

ELECTROPLATING METALS AND PARTICLES TO BE ELECTROPLATED

Examples of electroplating metals which can be used herein include, for example, metals such as copper, nickel cobalt, zinc, iron, tin, lead, silver, gold, platinum and palladium; and alloys such as iron-tin, iron-zinc, tin-lead, tin-zinc, nickel-chromium, copper-tin and iron-nickel-chromium.

Examples of preferred metallic particles which can used herein include, for example, particles of iron, copper, silver, gold, tin, platinum, nickel, titanium, cobalt, chromium, zinc, aluminum or tungsten, or alloys thereof, which are produced by various processes based on atomization, electrolysis, pulverization, reduction, vaporization in a gas of a reduced pressure, reaction of active hydrogen with a molten metal or reaction of a chloride.

Examples of preferred particles of ceramics which can be used herein include, for example, those of oxides such as $Al_2O_3$, $Cr_2O_3$, ZnO, $GeO_2$, $TiO_2$, $Y_2O_3$, $MoO_2$, $SiO_2$, PbO, $ZrO_2$, $WO_3$, $Fe_2O_3$, $BaTiO_3$, $Ta_2O_5$, cosellaite, zeolite, soft ferrite and partially stabilized zirconia; those of carbides such as SiC, $Cr_3C_2$, WC, TiC, $B_4C$, ZrC, MoC, $Fe_3C$, TaC, $Co_3C$, $Bi_3C$, NbC, graphite and carbon black; those of nitrides such as $Si_3N_4$, BN, TiN, AlN, ZrN, TaN, CrN, $W_2N$ and NbN; those of borides such as $CrB_2$, $ZrB_2$, $Fe_2B$, $Ni_2B$, NbB, $AlB_2$, $CaB_2$ and $Mo_2B$; those of sulfides such as CdS, $Cu_2S$, $MoS_2$, $TaS_2$ and SrS; and further particles of phosphides, silicides, carbonitrides and hydroxides of various metals, which particles of ceramics are produced by gas phase processes based on vaporization under heat and electric current, a hybrid plasma process, hydrolysis of a volatile metallic compound and reaction of a high melting compound. Furthermore, particles of naturally occurring ores such as sericite and mica can also be used.

Examples of preferred particles of plastics which can be used herein include, for example, those of polyolefins, polyamides, polymers of vinyl chlorides, acrylics, methacrylics, polymers of trifluorochloroethylene, polymers of acrylonitrile, silicone resins, polymers of vinylidene fluoride, epoxy resins, phenolic resins urea resins, urethane resins and polyester resins which are produced by various polymerization processes including emulsion polymerization, suspension polymerization, soapless polymerization and non-aqueous dispersion polymerization.

Particles which can be electroplated herein may be in any forms including sphere, needle, bar, cube, plate, indefinite shape, cluster whisker, hollow and porous, so far as they are of a size of from 0.1 to 10.0 μm.

The thickness of a metallic film electrochemically formed on particles by the electroplating process according to the invention may normally be from from 100 Å to 5 μm. An unduly thin metallic film does not substantially improve properties of the starting particles. Whereas an excessively thick metallic film does not necessarily add additional advantages to the electroplated product or to an intended final product, instead it does increase the costs of manufacture. A preferred thickness of the electroplated metallic film is from 0.1 to 3 μm.

Particles which have been electroplated with metal according to the invention may be further coated with other material or materials by an appropriate process such as a nonelectrode plating process, a substitution electroplating process or a CVD process. Further, a multiple layer metallic coat of different metals formed on particles of ceramics or plastics may be converted to a single layer alloy coat by heating the particles so as to cause the metals to diffuse.

Starting particles may be suitably pretreated depending upon the nature of the particles, and then coated with various metals by the electroplating process according to the invention. For example, aluminum particles may be subjected to a pretreatment comprising substitution plating with zinc and copper cyanide strike plating, and thereafter may be coated with various metals by the electroplating process according to the invention.

EXAMPLES

A. EXAMPLES WHEREIN THE APPARATUS SHOWN IN FIG. 5 WAS USED

EXAMPLE 1

Commercially available fine particles (1 kg) of tungsten having an average particle diameter of 0.7 μm supplied by SOEKAWA Chemicals Co., Ltd.) were stirred in an aqueous solution of potassium hydroxide having a concentration of 100 g/liter at a temperature of 25° C. for a period of 10 minutes to remove for removal of oxide films and surface conditioning. The particles so treated were washed with water, soaked in 500 cc of an aqueous solution of stannous chloride (containing 158 g/liter of $SnCl_2 2H_2O$ and having a pH of 2.0) at ambient temperature for 2 minutes for sensitizing purpose. The sensitized particles were then washed with water, soaked in 200 cc of an aqueous solution of palladium chloride (containing 0.2 g/liter of $PdCl_2$ and having a pH of 2.0) at a temperature of 40° C. for 3 minutes for activation purpose, and washed with water.

Nonelectrode plating of the so activated particles was carried out at a temperature of 50° C., for 5 minutes, using a nonelectrode copper plating liquid "OPC Copper" with formaldehyde as a reducing agent, which liquid was supplied by OKUNO Chemical Industries Co., Ltd., whereby fine tungsten particles each having a non electrode plated copper film of a thickness of about 100 Å were prepared.

The so prepared fine tungsten particles with a thin nonelectrode plated copper film having an average particle diameter of about 0.7 μm were subjected to the electroplating process according to the invention.

An apparatus of a type as shown in FIG. 5 was used. The tubular vessel 12 was made of a vinyl chloride resin, and each anode 3 was a plate made of phosphorus containing copper, which was covered with an anode bag 24 made of a polyester fabric. The cathode plate 2 was a disc made of titanium, and the diameter of the working surface 5 of the cathode plate 2 was equal to the inner diameter of the tubular vessel 12. The exhaling pipe 16 was disposed vertically and coaxially with the tubular vessel 12, with the exhaling opening 15 positioned above the working surface 5 of the cathode plate 2 by a predetermined distance. As the means 18 for circulating the electrolyte and suspended particles two slurry pumps the number of rotation of which was variable were used.

The apparatus was charged with 1000 cc of a copper electroplating aqueous solution containing 49 g of copper pyrophosphate, 254 g of potassium pyrophosphate and 23 g of potassium citrate, and all of the fine tungsten particles with a thin nonelectrode plated copper film prepared from 1 kg of the starting tungsten fine particles. The pumps were actuated and their numbers of rotation were adjusted so that the suspension would be exhaled from the exhaling opening 15 at a velocity of about 6.0 m/min. and the average particle concentration of the suspension at the time of collision with the working surface 5 of the cathode plate 2 would be about 30% by volume. After confirming the fact that a stationary circulating flow of the suspension which did not come in contact with the anode plates 3 had been formed, an electric current of a cathode current density of 5 A/dm$^2$ was caused to flow under a voltage of 12 volts. The apparatus was worked for 48 hours while maintaining the liquid temperature at 25° C.

By this working the fine tungsten particles with a thin nonelectrode plated copper film were electroplated with copper. The current efficiency was 95%. The weight of electroplated copper was 20% on average based on the weight of the product. The yield of the electroplated particles was 98%, and deposition of copper on the titanium cathode plate was observed not at all.

The product was examined by X-ray diffractometry. The diffraction pattern did not indicated any diffraction peals including those of copper and tungsten. It is believed, therefore, that the electroplated layer is deposited uniformly on the surface of particle and is nearly amorphous.

The product, that is, fine tungsten particles of a size of 0.7 μm with 20% by weight of copper electroplated, was pressed and sintered to provide an electrical joint material. The pressing was carried out at ambient temperature under a pressure of 410 MPa, and the sintering was carried out by heating the pressed article to a temperature of 1150° C. in a furnace of a hydrogen atmosphere at a rate of 100° C./min., maintaining that temperature for 2 hours and allowing the article to cool in the furnace. The sintered product exhibited a desirable combination of properties which could not be seen with conventional powder metallurgy joint materials, including a density of 15.0 g/cm3, a bending strength of 110 kg/mm2, a Rockwell hardness B of 103, an electric conductivity of 42% IACS (International Annealed Copper Standard, JIS C 3002) and a porosity of 0.5%. Further, the sintered product was subjected to arcing tests for testing arcing joints of circuit breakers. When compared with arcing joints prepared by a conventional powder mixing method wherein particulate tungsten and particulate copper are admixed, pressed and sintered, the sintered product of this Example exhibited remarkably excellent wear resistance as well as comparable resistance to molten adhesion contact resistance.

EXAMPLE 2

Using the same apparatus of Example 1, iron particles having an average diameter of 2.5 μm were electroplated with cobalt. The starting iron particles were not nonelectrode plated. They were degreased and acid pickled so as to expose metallic surface of iron, and thereafter subjected to electroplating. The particle concentration of the suspension and the exhaling velocity were set 30% by volume and 6.0 m/min., respectively, as in Example 1. Other conditions employed were as follows:

Composition of the electroplating liquid: 180 g/liter of cobalt ammonium sulfate and 25 g/liter of boric acid;
Amount of the electroplating liquid: 1 liter;
Amount of fine particles: 1 kg;
Current density: 2A/dm$^2$;
Voltage: 7 V.;
Temperature of the electroplating liquid: 30°–40° C.;
Electroplating time: 150 hours.

By the electroplating under the above-described conditions iron particles coated with cobalt of an average thickness of 0.7 μm were prepared. The current efficiency of the process was 92%, and the yield of electroplated particles was 95%.

The electroplated particles so prepared were pressed and sintered as in Example 1. The sintered product was suitable for use as a magnetic material.

EXAMPLE 3

Using the same apparatus of Example 1, iron particles having an average diameter of 5.0 μm were electroplated with lead. The starting iron particles were nonelectrode plated with copper as in Example 1 (the thickness of the nonelectrode plated copper film was 50 Å), and thereafter subjected to electroplating. The particle concentration of the suspension and the exhaling velocity were set 30% by volume and 6.0 m/min., respectively, as in Example 1. Other conditions employed were as follows:

Composition of the electroplating liquid: 200 g/liter of lead fluoborate, 20 g/liter of hydrofluoboric acid (42%) 20 g/liter of boric acid and 0.15 g/liter of gelatin;
Amount of the electroplating liquid: 1 liter;
Amount of fine particles: 1 kg;
Current density: 5 A/dm$^2$;
Voltage: 6 V;
Temperature of the electroplating liquid: 30°–40° C.;
Electroplating time: 120 hours.

By the electroplating under the above-described conditions iron particles coated with lead of an average thickness of 2.0 μm were prepared. The current efficiency of the process was 92%, and the yield of electroplated particles was 99%.

The electroplated particles so prepared were pressed and sintered as in Example 1. The sintered product was suitable for use as a corrosion and wear resistant material.

EXAMPLE 4

Using the same apparatus of Example 1, stainless steel (SUS 304) particles having an average diameter of 10.0 μm were electroplated with nickel. The starting stainless steel particles were nonelectrode plated with nickel-phosphorus of a thickness of 100 Å, and thereafter subjected to electroplating. The particle concentration of the suspension and the exhaling velocity were set 30% by volume and 6.0 m/min., respectively, as in Example 1. Other conditions employed were as follows:

Composition of the electroplating liquid: 150 g/liter of nickel sulfate, 15 g/liter of ammonium chloride and 15 g/liter of boric acid,
Amount of the electroplating liquid: 1 liter;
Amount of fine particles: 1 kg;
Current density: 3 A/dm$^2$;
Voltage: 8 V;
Temperature of the electroplating liquid: 30°–40° C.;

Electroplating time: 40 hours.

By the electroplating under the above-described conditions stainless steel particles coated with nickel of an average thickness of 1.0 μm were prepared. The current efficiency of the process was 90%, and the yield of electroplated particles was 98%.

The electroplated particles so prepared were pressed and sintered as in Example 1. The sintered product was suitable for use as a metallic filter.

EXAMPLE 5

Using the same apparatus of Example 1, chromium particles having an average diameter of 5.0 μm were electroplated with iron. The starting chromium particles were not nonelectrode plated. They were degreased and acid pickled, and thereafter subjected to electroplating. The particle concentration of the suspension and the exhaling velocity were set 30% by volume and 6.0 m/min., respectively, as in Example 1. Other conditions employed were as follows:

Composition of the electroplating liquid: 240 g/liter of ferrous chloride and 180 g/liter of potassium chloride;

Amount of the electroplating liquid: 1 liter;

Amount of fine particles: 1 kg;

Current density: 5 A/dm$^2$;

Voltage: 8 V.;

Temperature of the electroplating liquid: 40°-50° C.;

Electroplating time: 120 hours.

By the electroplating under the above-described conditions chromium particles coated with iron of an average thickness of 2.0 μm were prepared. The current efficiency of the process was 90%, and the yield of electroplated particles was 95%.

The electroplated particles so prepared were pressed and sintered as in Example 1. The sintered product was suitable for use as a heat resistant anti-corrosive material.

COMPARATIVE EXAMPLES A TO D

Example 1 was repeated except that the particle concentration and exhaling velocity of the suspension were set as indicated in Table 1. The results are shown in Table 1. By the term "yield of electroplated particles" we mean percent by weight of metal deposited on particles based on the total weight of deposited metal. By the term "% deposition on cathode" is meant percent by weight of metal deposited on cathode based on the total weight of deposited metal. Accordingly, the sum of the yield of electroplated particles and the % deposition on cathode should be substantially 100%.

From Table 1, it will be understood that in cases wherein the particle concentration of the suspension and/or the velocity of particles colliding with the cathode deviate from the respective proper ranges prescribed herein, the more the deviation the more the deposition on cathode and in turn the less the deposition on particles. Accordingly, in order to electroplate fine particles at a high yield it is essential to control the particle concentration of the suspension and the velocity of particles colliding with the cathode as prescribed herein.

TABLE 1

| | Conditions | | Results | |
|---|---|---|---|---|
| Comp. Ex. | Particle Conc. of suspension | Exhaling velocity of particles | Yield of electro-plated particles | % deposition on cathode |
| A | 30 vol. % | 20 m/min. | 60% | 40% |
| B | 30 vol. % | 10 m/min. | 80% | 20% |
| C | 20 vol. % | 6 m/min. | 50% | 50% |
| D | 10 vol. % | 6 m/min. | 0% | 100% |

B. EXAMPLES WHEREIN THE APPARATUS SHOWN IN FIGS. 6 AND 7 WAS USED

EXAMPLES 6

In this examples a tilt punched board rotor shown in FIGS. 10 and 11 was used.

Commercially available fine particles (1 kg) of alpha-alumina having an average particle diameter of 0.3 μm supplied by SUMITOMO Chemical Industries Co., Ltd.) were soaked in 1000 cc of an aqueous solution of stannous chloride (containing 158 g of $SnCl_2 2H_2O$ and having a pH of 2.0) at ambient temperature for 2 minutes for sensitizing purpose. The sensitized particles were then washed with water, soaked in 500 cc of an aqueous solution of palladium chloride (containing 0.2 g/liter of $PdCl_2$ and having a pH of 2.0) at a temperature of 40° C. for 3 minutes for activation purpose, and washed with water.

Nonelectrode plating of the so activated particles was carried out at a temperature of 60° C., for 10 minutes, using a nonelectrode plating liquid "Shumer—S680" supplied by Nippon KANIZEN Co., Ltd., whereby fine particles of alpha-alumina each having a nonelectrode plated nickel-phosphorus film of a thickness of about 1000 Å were prepared.

The so prepared fine alpha-alumina particles with a thin nonelectrode plated nickel-phosphorus film were subjected to the electroplating process according to the invention.

An apparatus of a type as shown in FIGS. 6 and 7 was used. The tubular vessel 25 was made of a vinyl chloride resin, and each anode 3 was a plate made of iron, which was covered with an anode bag made of a polyester fabric. The cathode plate 2 was a disc made of titanium, and the diameter of the working surface 5 of the cathode plate 2 was equal to the inner diameter of the tubular vessel 25. Four flow-rectifying plates 27, each having a width of about 10% of a diameter of the vessel 25, were vertically disposed along the inner wall of the vessel 25 with an interval of 90°. The upper end 28 of each flow-rectifying plate 27 was positioned at a level below the lower end 19 of the anode 3. As a propeller 26, a tilt punched board rotor 33, as shown in FIGS. 10 and 11, secured to a shaft of rotation 29 with a tilt angle of 15°, was used. The shaft 29 was disposed vertically and coincidentally with the central axis of the vessel 25.

The apparatus was charged with 1 liter of an aqueous ferrous chloride solution containing 240 g of ferrous chloride and 180 g of potassium chloride, and all of the above-nonelectrode plated fine alpha-alumina particles (prepared from 1 kg of the starting alpha-alumina fine particles). The rotor 33 was caused to rotate and the number of rotation was adjusted so that the particles would be brought in collision with the working surface 5 of the cathode plate 2 at a velocity of a normal component of about 0.6 m/min. The so adjusted number of rotation of the rotor was about 120 rpm. A stationary circulating flow of the suspension was formed in which the suspension that had been brought in collision with the working surface 5 of the cathode plate 2 was cause to flow upwardly along the inner wall of the vessel 25 up to the upper ends 28 of the flow-rectifying plates 27 and, without coming in contact with the anode, again directed downwardly toward the working surface 5 of the cathode plate 2 by the action of the rotor. In this stationary state the particle concentration of the suspension was about 50% by weight in the vicinity of the working surface 5 of the cathode plate 2.

The perforations 32 of the rotor 33 promoted the agitation of the suspension as a whole, whereby the suspension was circulated while maintaining the thick particle concentration and forming fluidized layers substantially uniform in all directions.

After confirming the fact that the stationary circulating flow of suspension had been formed, an electric current of a cathode current density of 5 A/dm$^2$ was caused to flow under a voltage of 16 volts. The apparatus was continuously worked for a period of 500 hours while maintaining the liquid temperature at 25° C.

By this working the fine alpha-alumina particles with a thin nonelectrode plated nickel-phosphorus film were electroplated with iron. The current efficiency was 90%. The weight of electroplated iron was 50% on average based on the weight of the product. The yield of the electroplated particles was 90%, and deposition of iron on the titanium cathode plate was observed not at all.

The product was examined by X-ray diffractometry. The diffraction pattern did not indicated any diffraction peals including those of iron and nickel. It is believed, therefore, that the electroplated layer is deposited uniformly on the surface of particle and is nearly amorphous.

The electroplated particles so prepared were pressed and sintered as in Example 1. The sintered product was suitable for use as a material of a permeable mold.

EXAMPLE 7

Using the same apparatus of Example 6, particles of a vinyl chloride resin having an average diameter of 10.0 μm were electroplated with a tin-lead alloy. The starting resin particles were previously nonelectrode plated with copper of a thickness of 300 Å, and thereafter subjected to electroplating. The particle concentration of the suspension and the normal velocity component of particles coming in collision with the working surface 5 of the cathode plate 2 were set 50% by volume and 0.6 m/min., respectively, as in Example 6. Other conditions employed were as follows:

Composition of the electroplating liquid: 150 g/liter of stannous fluoborate, 50 g/liter of lead fluoborate, 100 cc/liter of hydrofluoboric acid (42%), 11 g/liter of boric acid and 5 g/liter of gelatin;

Amount of the electroplating liquid: 1 liter;

Amount of fine particles: 100 g;

Current density: 3 A/dm$^2$;

Voltage: 5 V.;

Temperature of the electroplating liquid: 30°–40° C.;

Electroplating time: 30 hours.

By the electroplating under the above-described conditions vinyl chloride resin particles coated with a tin-lead alloy (Sn/Pb=70/30 by weight) of an average thickness of 1.0 μm were prepared. The current efficiency of the process was 90%, and the yield of electroplated particles was 99%.

The electroplated particles so prepared are useful as a light weight composite material.

EXAMPLE 8

Using the same apparatus of Example 6, titanium particles having an average diameter of 10.0 μm were electroplated with nickel. The starting titanium particles were previously nonelectrode plated with nickel-phosphorus of a thickness of 300 Å0 as in Example 6, and thereafter subjected to electroplating. The particle concentration of the suspension and the normal velocity component of particles coming in collision with the working surface 5 of the cathode plate 2 were set 50% by volume and 0.6 m/min., respectively, as in Example 6. Other conditions employed were as follows:

Composition of the electroplating liquid: 450 g/liter of nickel sulfamate and 45 g/liter of boric acid;

Amount of the electroplating liquid: 1 liter;

Amount of fine particles: 1 kg;

Current density: 5 A/dm$^2$;

Voltage: 10 V.;

Temperature of the electroplating liquid: 30°–40° C.;

Electroplating time: 100 hours.

By the electroplating under the above-described conditions, titanium particles coated with nickel of an average thickness of 3.0 μm were prepared. The current efficiency of the process was 95%, and the yield of electroplated particles was 97%.

The electroplated particles so prepared are useful as a shape-memory alloy.

EXAMPLE 9

Using the same apparatus of Example 6, fine particles of titanium carbonitride having an average diameter of 2.0 μm were electroplated with cobalt. The starting titanium carbonitride particles were previously nonelectrode plated with nickel-phosphorus of a thickness of 10 Å as in Example 6, and thereafter subjected to electroplating. The particle concentration of the suspension and the normal velocity component of particles coming in collisions with the working surface 5 of the cathode plate 2 were set 50% by volume and 0.6 m/min., respectively, as in Example 6. Other conditions employed were as follows:

Composition of the electroplating liquid: 450 g/liter of cobalt sulfamate and 30 ml/liter of formamide:

Amount of the electroplating liquid: 1 liter;

Amount of fine particles: 1 kg;

Current density: 2 A/dm$^2$;

Voltage: 7 V.;

Temperature of the electroplating liquid: 30°–40° C.;

Electroplating time: 10 hours.

By the electroplating under the above-described conditions, particles of titanium carbonitride coated with cobalt of an average thickness of 0.1 μm were prepared. The current efficiency of the process was 98%, and the yield of electroplated particles was 99%.

The electroplated particles so prepared are useful as an ultra-hard alloy.

EXAMPLE 10

Using the same apparatus of Example 6, mica particles having an average diameter of 5.0 μm were electroplated with nickel. The starting mica particles were previously nonelectrode plate with copper of a thickness of 1000 Å, and thereafter subjected to electroplating. The particle concentration of the suspension and the normal velocity component of particles coming in collision with the working surface 5 of the cathode plate 2 were set 50% by volume and 0.6 m/min., respectively, as in Example 6. Other conditions employed were as follows:

Composition of the electroplating liquid: 450 g/liter of nickel sulfamate and 45 g/liter of boric acid;

Amount of the electroplating liquid: 1 liter;

Amount of fine particles: 100 g;

Current density: 3 A/dm$^2$;

Voltage: 8 V.;

Temperature of the electroplating liquid: 30°–40° C.;

Electroplating time: 300 hours.

By the electroplating under the above-described conditions, mica particles coated with nickel of an average thickness of 2.0 μm were prepared. The current efficiency of the process was 90%, and the yield of electroplated particles was 95%.

The electroplated particles so prepared were pressed and sintered as in Example 1. The sintered product is suitable for use as a conductive filler.

COMPARATIVE EXAMPLES E TO H

Example 6 was repeated except that the particle concentration of the suspension and the normal velocity component of particles coming in collision with the working surface 5 of the cathode plate 2 were set as indicated in Table 2. The results are shown in Table 2.

From Table 2, it will be understood that in cases wherein the particle concentration of the suspension and/or the velocity of particles colliding with the cathode deviate from the respective proper ranges prescribed herein, the more the deviation the more the deposition on cathode and in turn the less the deposition on particles. Accordingly, in order to electroplate fine particles at a high yield it is essential to control the particle concentration of the suspension and the velocity of particles colliding with the cathode as prescribed herein.

TABLE 2

| | Conditions | | Results | |
|---|---|---|---|---|
| Comp. Ex. | Particle Conc. of suspension | Normal velocity component | Yield of electro-plated particles | % deposition on cathode |
| E | 50 vol. % | 0.1 m/min. | 40% | 60% |
| F | 50 vol. % | 0.3 m/min. | 80% | 20% |
| G | 20 vol. % | 0.6 m/min. | 70% | 30% |
| H | 10 vol. % | 0.6 m/min. | 0% | 100% |

What is claimed is:

1. A process for electroplating fine particles with metal by suspending electrically conductive fine particles in a metallic ion-containing electrolyte in an electroplating bath equipped with a cathode and anode, and passing a direct electric current between the cathode and anode thereby depositing metallic ions in the electrolyte on surfaces of the fine particles, wherein said fine particles have a size of from 0.1 to 10 μm, wherein a flow of a suspension of said fine particles in the electrolyte continuously flowing is forcibly formed in said bath while keeping said fine particles in the suspended condition in said electrolyte, wherein said flow of said suspension is controlled so that its main direction of flow in the bath is such that while said suspension is circulated substantially without coming in collision with said anode, said fine particles in said suspension may have a chance of colliding with substantially all surface areas of said cathode that are exposed to said bath, and wherein a flow rate and particle concentration of said suspension are controlled so that said fine particles may repeatedly come in collision with said cathode at a velocity with a normal component of ranging from 0.6 to 6.0 m/min., and a particle concentration of said suspension at the time of collision is from 30 to 55% by volume.

2. The process in accordance with claim 1 wherein said electrically conductive fine particles are particulate inorganic or organic fine substance having formed on said surface an electrically conductive film.

3. The process in accordance with claim 1 wherein said electrically conductive fine particles are particulate metal.

* * * * *